US008219014B2

(12) United States Patent
Hayashi

(10) Patent No.: US 8,219,014 B2
(45) Date of Patent: Jul. 10, 2012

(54) IMAGE HEATING APPARATUS HAVING MAGNETIC FLUX CONFINING MEANS

(75) Inventor: Yasuhiro Hayashi, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 509 days.

(21) Appl. No.: 12/437,991

(22) Filed: May 8, 2009

(65) Prior Publication Data

US 2009/0285609 A1 Nov. 19, 2009

(30) Foreign Application Priority Data

May 13, 2008 (JP) ..... 2008-125486

(51) Int. Cl.
*G03G 15/20* (2006.01)
*G03G 21/20* (2006.01)
*H05B 6/14* (2006.01)

(52) U.S. Cl. ..... 399/328; 219/619; 399/329; 399/336

(58) Field of Classification Search ..... 399/328, 399/329, 335, 336; 219/619, 665, 667
See application file for complete search history.

(56) References Cited

U.S. PATENT DOCUMENTS

| | | | | |
|---|---|---|---|---|
| 4,675,487 | A * | 6/1987 | Verkasalo | 219/619 |
| 6,347,201 | B1 * | 2/2002 | Sano et al. | 399/67 |
| 6,704,537 | B2 * | 3/2004 | Takeuchi et al. | 399/328 |
| 6,782,216 | B2 * | 8/2004 | Suzuki | 399/69 |
| 6,947,699 | B2 * | 9/2005 | Suzuki et al. | 399/329 |
| 7,106,999 | B2 | 9/2006 | Takahashi | |
| 7,200,354 | B2 | 4/2007 | Nakamoto et al. | |
| 7,263,306 | B2 | 8/2007 | Hayashi | |
| 7,317,881 | B2 | 1/2008 | Hayashi | |
| 7,457,576 | B2 | 11/2008 | Takada et al. | |
| 7,466,950 | B2 | 12/2008 | Matsuura et al. | |
| 7,558,519 | B2 | 7/2009 | Jinzai et al. | |
| 7,596,348 | B2 | 9/2009 | Nakamoto et al. | |
| 7,970,329 | B2 * | 6/2011 | Suzuki | 399/329 |
| 2005/0041991 | A1 | 2/2005 | Ihara et al. | |
| 2005/0173415 | A1 * | 8/2005 | Yamamoto et al. | 219/619 |
| 2007/0071523 | A1 * | 3/2007 | Suzuki | 399/329 |
| 2007/0127958 | A1 * | 6/2007 | Matsuura et al. | 399/328 |
| 2007/0230983 | A1 * | 10/2007 | Nakamoto et al. | 399/69 |
| 2007/0230984 | A1 * | 10/2007 | Noguchi | 399/69 |
| 2007/0231026 | A1 | 10/2007 | Hayashi et al. | |

(Continued)

FOREIGN PATENT DOCUMENTS

EP 2 031 464 3/2004

(Continued)

*Primary Examiner* — David Gray
*Assistant Examiner* — Fred L Braun
(74) *Attorney, Agent, or Firm* — Fitzpatrick, Cella, Harper & Scinto

(57) ABSTRACT

An apparatus includes a rotatable image heater for heating a recording material, a coil, outside the heater, for generating magnetic flux for heating the heater and having an end outside an end of the heater with respect to the rotational axis direction, a pressor contacting the heater outer surface for forming a nip nipping and conveying the recording material, a metal member for pressing the pressor through the heater and having an end which is located outside the end of the heater and outside an end of the coil with respect to the rotational axis direction, and a magnetic flux confiner disposed inside the heater between the coil and the metal member, for confining the magnetic flux from the coil so as not to extend toward the metal member and having an end located outside the end of the heater with respect to the rotational axis direction.

17 Claims, 10 Drawing Sheets

U.S. PATENT DOCUMENTS

2007/0274748 A1 11/2007 Yoshikawa

FOREIGN PATENT DOCUMENTS

JP 2000214703 A * 8/2000
JP 2004228043 A * 8/2004
JP 2005-24791 1/2005
JP 2005-203272 7/2005
JP 2006-267742 10/2006
JP 2007279672 A * 10/2007
JP 2008191259 A * 8/2008

* cited by examiner

IMAGE HEATING APPARATUS HAVING MAGNETIC FLUX CONFINING MEANS

FIELD OF THE INVENTION AND RELATED ART

The present invention relates to an electromagnetic induction heating type image heating apparatus used as an image heating apparatus mountable to an image forming apparatus, such as a copying machine, a printer, or a facsimile machine, for effecting image formation through an electrophotographic method and an electrostatic recording method.

As a conventional constitution of a fixing device as an image heating apparatus for heat-fusing and fixing an unfixed toner image in the image forming apparatus employing the electrophotographic method, those of various types have been proposed. As one of such fixing devices, an induction heating type fixing device using a fixing belt as a fixing member has been disclosed, e.g., in Japanese Laid-Open Patent Application (JP-A) 2006-267742 or JP-A 2005-203272.

In this fixing device, a coil generating magnetic flux is opposed to an outside of the fixing belt and a magnetic member is disposed on an inside of and on the outside of the fixing belt. By such a constitution a temperature distribution of the fixing belt with respect to a longitudinal direction of the fixing belt is intended to be uniformed.

However, the above-described conventional fixing device is accompanied with the following problem. In the fixing device disclosed in JP-A 2006-267742, a heat generation density of the fixing belt by an induction heating coil at both end portions of the fixing belt with respect to a longitudinal direction of the fixing belt is lower than that at a central portion of the fixing belt. For that reason, in order to uniformize a longitudinal direction temperature distribution of the fixing belt over a width of paper used, a width of the induction heating coil is required to be larger than a maximum sheet width of available paper.

In another aspect, in order to shorten a rise time from main switch actuation until the fixing member reaches a predetermined temperature, realization of low heat quantity of the fixing member by shortening a length of the fixing member such as the fixing belt is effective.

When the length of the fixing member is shortened in this way, an end of the induction heating coil is located outside an end of the fixing member.

A stay (an urging member) for forming a nip in which a recording material is to be nipped and conveyed is required to ensure a high pressure for fixation in the nip, so that the stay requires rigidity and therefore a metal member is used as the stay. This metal member may preferably have a constitution such that the metal member is extended to an outside of the fixing member and is subjected to pressure application at an extended portion in order to exert a sufficient pressure to a pressing member through the fixing member. When such a constitution is employed, an end of the stay unnecessarily generates heat by magnetic flux from the coil, so that it is difficult to adjust a distribution of heat generation of the fixing member with respect to a longitudinal direction of the fixing member.

SUMMARY OF THE INVENTION

A principal object of the present invention is to provide an electromagnetic induction heating type image heating apparatus capable of suppressing heat generation at ends of a metal member.

According to an aspect of the present invention, there is provided an image heating apparatus comprising:

a rotatable image heating member, including an electroconductive layer, for heating a recording material by heat;

a coil, disposed outside the image heating member, for generating magnetic flux for generating heat in the electroconductive layer, the coil having an end, with respect to a rotational axis direction of the image heating member, located outside the end of the image heating member with respect to the rotational axis direction;

a pressing member, contacting an outer surface of the image heating member, for forming a nip in which the recording material is to be nipped and conveyed;

a metal member, contacting an inner surface of the image heating member, for pressing the pressing member through the image heating member, the metal member having an end located outside the end of the image heating member with respect to the rotational axis direction; and magnetic flux confining means, disposed inside the image heating member and between the coil and the metal member, for confining the magnetic flux from the coil so as not to extend toward the metal member, the magnetic flux confining means having an end located outside the end of the image heating member with respect to the rotational axis direction.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, the present invention will be described based on several preferred embodiments with reference to the drawings but is not limited thereto.

[Embodiment 1]

(1) Image Forming Apparatus

Figure 1:
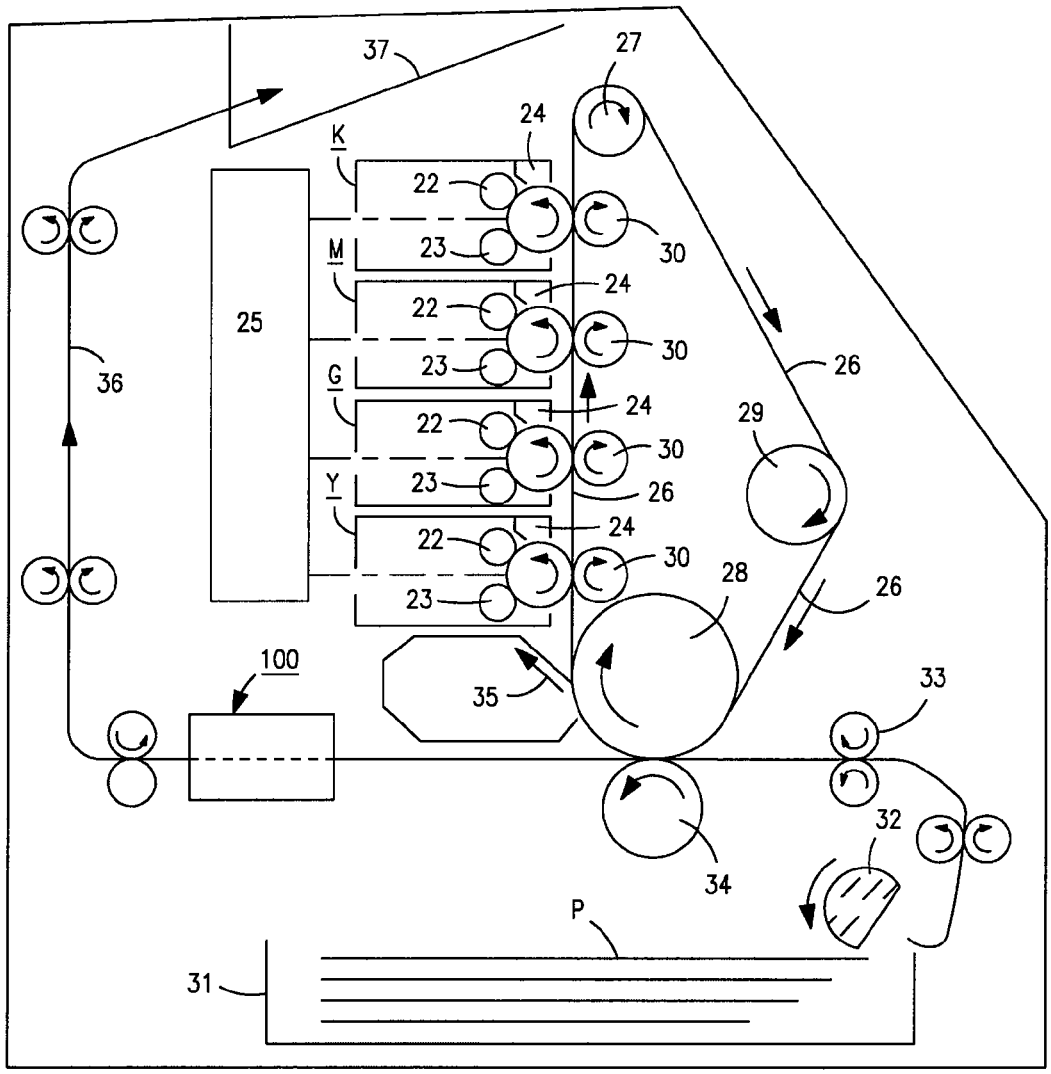
FIG. 1 is a schematic view of an embodiment of an image forming apparatus.

FIG. 1 is a schematic view of an embodiment of an image forming apparatus in which an image heating apparatus according to the present invention is mounted as a fixing device. This image forming apparatus is a color image forming apparatus using an electrophotographic method.

Y, C, M and K represent four image forming stations for forming color toner images of yellow, cyan, magenta, and black, respectively, and are arranged in this order from a lower portion to an upper portion. Each of the image forming stations, Y, C, M, and K includes a photosensitive drum 21, a charging device 22, a developing device 23, a cleaning device 24, and the like.

In the developing device 23 for the image forming station Y, yellow toner is accommodated and in the developing device 23 for the image forming station C, cyan toner is accommodated. Further, in the developing device 23 for the image forming station M, magenta toner is accommodated and in the developing device 23 for the image forming station K, black toner is accommodated.

An optical system 25 for forming an electrostatic latent image by subjecting each of the photosensitive drums 21 to exposure to light is provided correspondingly to the above-described four color image forming stations Y, C, M and K. As the optical system, 25, a laser scanning exposure optical system is used.

At each of the image forming stations, Y, C, M and K, the photosensitive drum 21 electrically charged uniformly by the charging device 22 is subjected to scanning exposure on the basis of image data by the optical system 25, so that an electrostatic latent image corresponding to a scanning exposure image pattern is formed on the photosensitive drum surface.

The resultant electrostatic latent images are developed into the toner images by the developing devices 23. That is, a yellow toner image is formed on the photosensitive drum 21 for the image forming station Y and a cyan toner image is formed on the photosensitive drum 21 for the image forming station C. Further, a magenta toner image is formed on the photosensitive drum 21 for the image forming station M and a black image is formed on the photosensitive drum 21 for the image forming station K.

The above-described color toner images formed on the photosensitive drums 21 for the respective image forming stations Y, C, M and K are successively primary-transferred onto an intermediary transfer member 26, rotated in synchronism with and at the substantially same speed as rotation of the respective photosensitive drums 21, in a predetermined alignment station in a superposition manner. As a result, unfixed full-color toner images are synthetically formed on the intermediary transfer member 26. In this embodiment, as the intermediary transfer member 26, an endless intermediary transfer belt is used and is stretched around three rollers consisting of a driving roller 27, a secondary transfer opposite roller 28, and a tension roller 29, thus being driven by the driving roller 27.

As a primary transfer means for transferring the toner image from the photosensitive drum 21 for each of the image forming stations Y, C, M and K onto the intermediary transfer belt 26, a primary transfer roller 30 is used. To the primary transfer roller 30, a primary transfer bias of a polarity opposite to that of the toner is applied from an unshown bias power source. As a result, the toner image is primary-transferred from the photosensitive drum 21 for each of the image forming stations Y, C, M and K onto the intermediary transfer belt 26. After the primary-transfer from the photosensitive drum 21 onto the intermediary transfer belt 26 at each of the image forming stations Y, C, M and K, toner remaining on the photosensitive drum 21 as transfer residual toner is removed by the cleaning device 24.

The above-described steps are performed with respect to the respective colors of yellow, cyan, magenta, and black in synchronism with the rotation of the intermediary transfer belt 26 to successively form the primary-transfer toner images for the respective colors on the intermediary transfer belt 26 in the superposition manner. Incidentally, during image formation for only a single color (in a single color mode), the above-described steps are performed for only an objective color.

A recording material P in a recording material cassette 31 is separated and fed by a feeding roller 32 one by one. The fed recording material P is conveyed, with predetermined timing by registration rollers 33, to a transfer nip (portion) which is a press-contact portion between a secondary transfer roller 34 and an intermediary transfer belt 26 portion extended around the secondary transfer opposite roller 28.

The color toner images formed on the intermediary transfer belt 26 are simultaneously transferred onto the recording material P by a bias, of a polarity opposite to that of the toner, applied from an unshown bias power source to the secondary transfer roller 34. After the secondary transfer, secondary transfer residual toner remaining on the intermediary transfer belt 26 is removed by an intermediary transfer belt cleaning device 35.

The toner images secondary-transferred onto the recording material P is fixed through fusing and mixing on the recording material P by a fixing device 100 as the image heating apparatus, so that the recording material P is sent, as a full-color print, to a sheet discharge tray 37 through a sheet discharge path 36.

(2) Fixing Device 100

In the following description, with respect to the fixing device 100, a front surface refers to a surface as seen from a recording material entrance side with respect to a conveyance direction of the recording material, and a rear surface is a surface (a recording material exit side) opposite from the front surface. The left (side) and the right (side) refer to left (side) and right (side) as seen from the front surface side. An upstream side and a downstream side refer to an upstream side and a downstream side with respect to the recording material conveyance direction. Further, a longitudinal direction of the fixing device or members constituting the fixing device refers to a direction parallel to a direction perpendicular to the recording material conveyance direction in a plane of a recording material conveyance path. A widthwise (short-side) direction refers to a direction parallel to the recording material conveyance direction. Further, a sheet passing width of the recording material refers to a recording material dimension with respect to the direction perpendicular to the recording material conveyance direction in a recording material plane.

Figure 2:
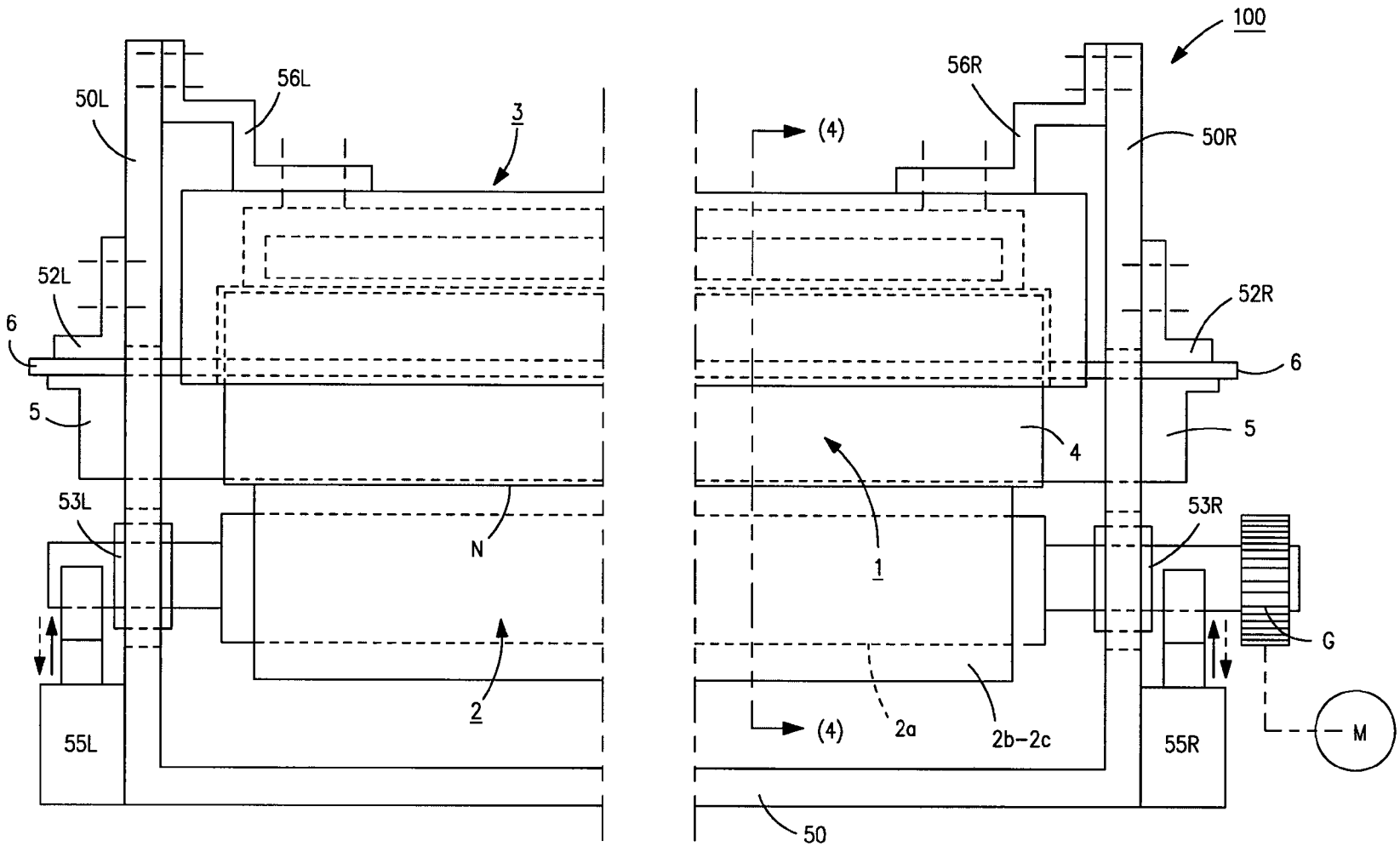
FIG. 2 is a partly omitted front view of a fixing device.
Figure 3:
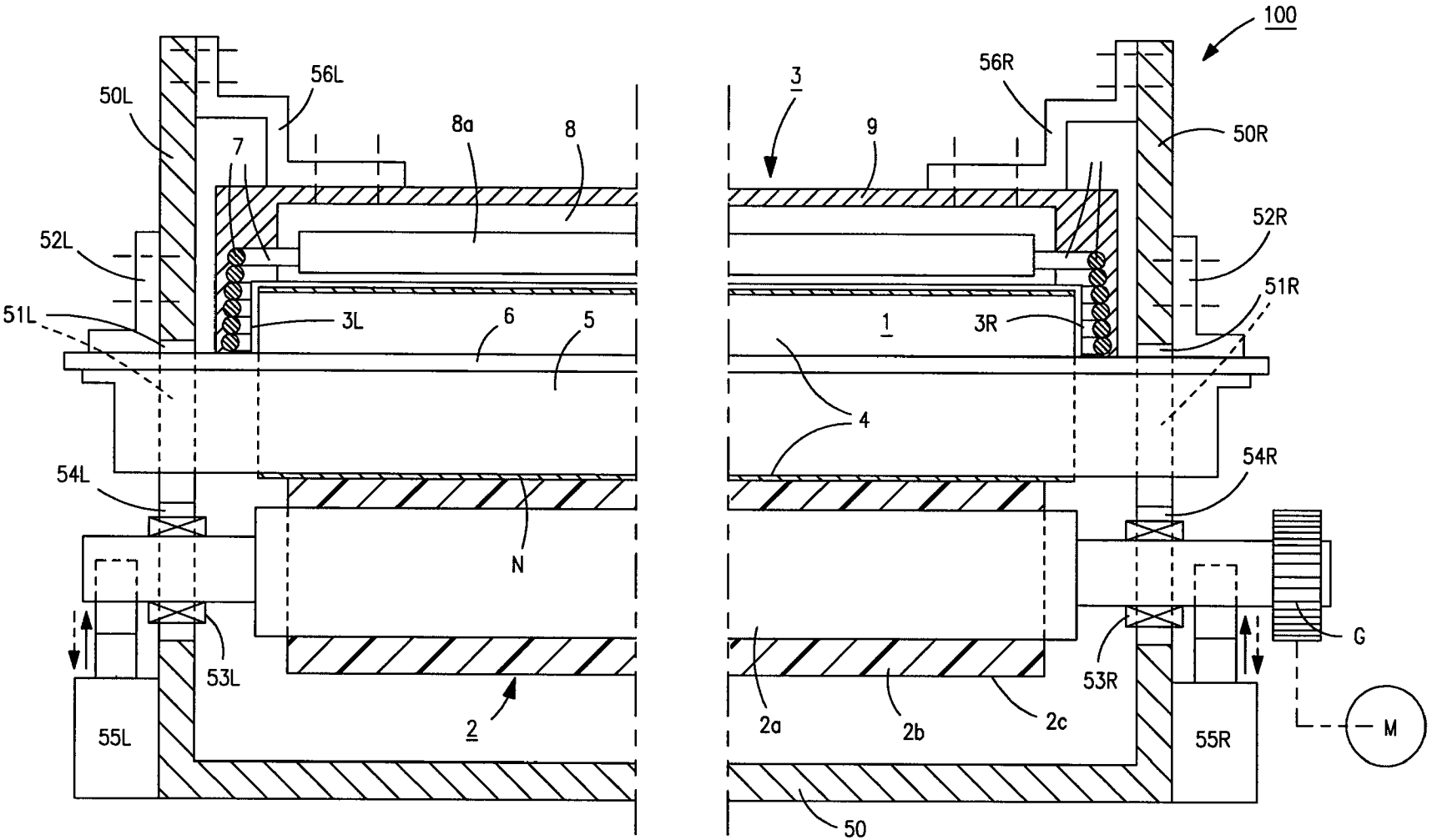
FIG. 3 is a partly omitted longitudinal-sectional front view of the fixing device.
Figure 4:
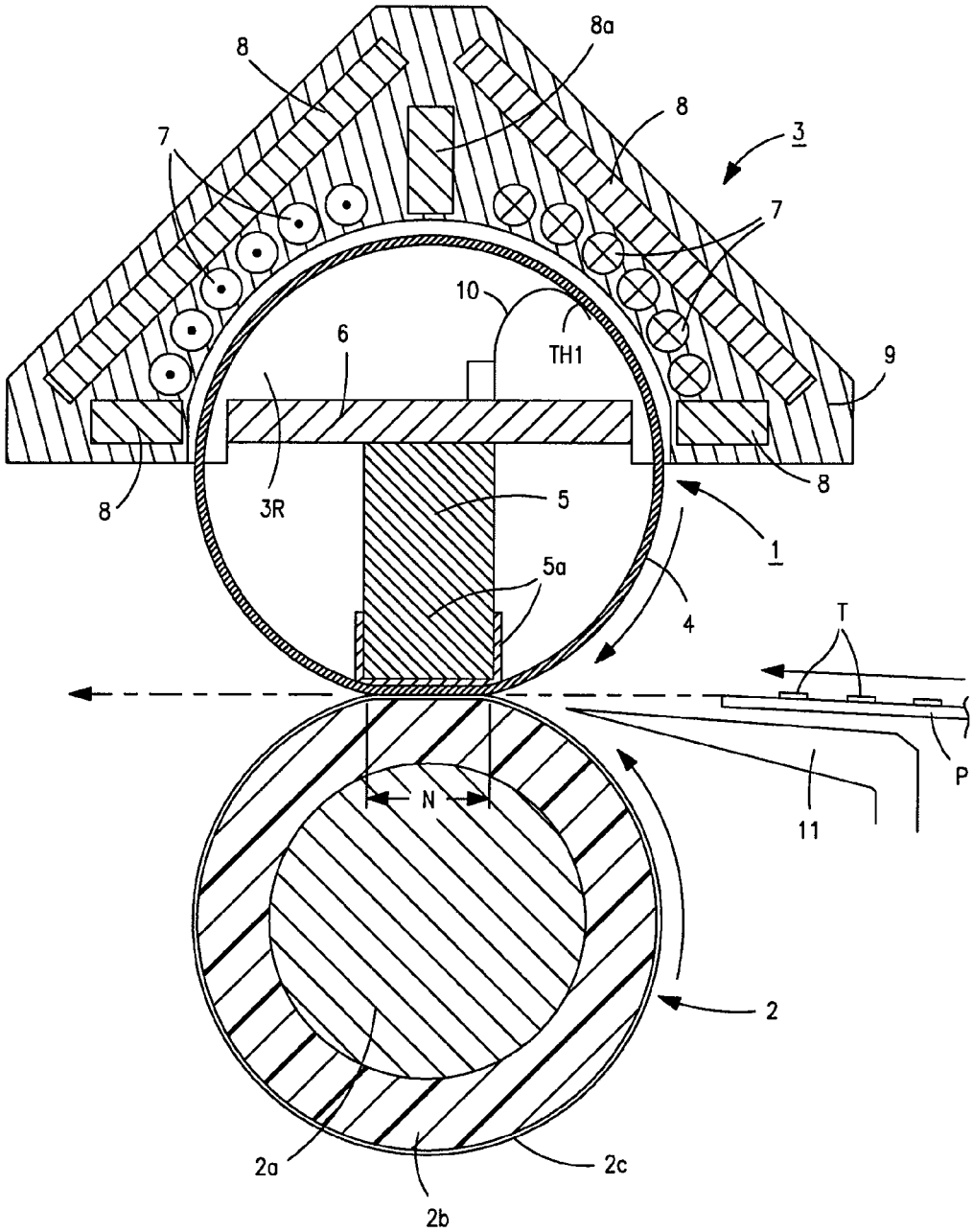
FIG. 4 is an enlarged cross-sectional view taken along (4)-(4) line indicated in FIG. 2.

FIG. 2 is a partly omitted front view of the fixing device 100 in this embodiment, FIG. 3 is a partly omitted longitudinal-sectional front view of the fixing device, and FIG. 4 is an enlarged cross-sectional view taken along (4)-(4) line indicated in FIG. 2.

This fixing device 100 includes a heating assembly 1, a pressing roller having elasticity as a pressing member, and a coil unit 3 as a heating source which are provided between left and right side plates 50L and 50R of a frame (chassis) of the fixing device 100.

a. Heating Assembly 1

The heating assembly 1 includes an electroconductive layer to be subjected to induction heating and includes a fixing belt 4 (belt member), which has a cylindrical shape (endless belt shape) and flexibility, as a rotatable image heating member (fixing member). Further, the heating assembly 1 includes an urging member (stay or metal member) 5 and a magnetic core 6, as a magnetic flux confining means for confining an induction magnetic field generated by the coil unit 3 so as not to act on the urging member 5, which are inserted into the fixing belt 4. In this embodiment, as the magnetic flux confining means, the magnetic core 6 is used but a similar effect can be achieved by employing a constitution in which a metal member such as copper having a resistivity lower than that of the electroconductive layer.

Figure 5:
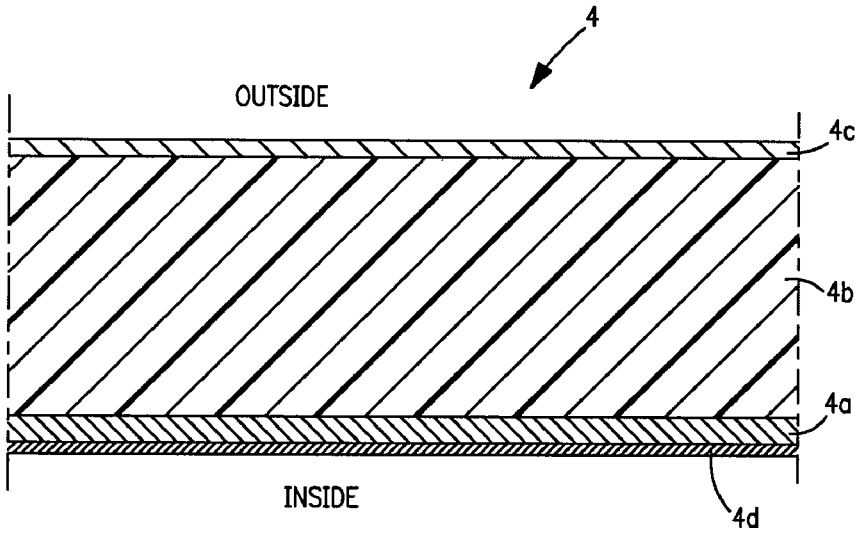
FIG. 5 is a schematic view showing a layer structure of a fixing belt.

FIG. 5 is a schematic view showing a layer structure of the fixing belt 4. The fixing belt 4 includes a metal layer 4*a*, which is the electroconductive layer, as a base layer. In this embodiment, the metal layer 4*a* is a nickel layer manufactured through electroforming to have an inner diameter of 30 mm and a thickness of 40 μm.

At an outer peripheral surface of the metal layer 4*a*, a heat-resistant silicone rubber layer is provided as an elastic layer 4*b*. The thickness of this silicone rubber layer may preferably be set within a range from 100 μm to 1000 μm. In this embodiment, the thickness of the silicone rubber layer 4*b* is set at 300 μm in consideration that thermal capacity of the fixing belt 4 is decreased to shorten a warming-up time and a suitable fixation image is obtained during the fixation of the color images. The silicone rubber has a JIS-A hardness of 20 degrees and a thermal conductivity of 0.8 W/mK.

Further, at an outer peripheral surface of the silicone rubber layer 4*b*, a fluorine-containing resin material layer (e.g., of PFA or PTFE) as a surface parting layer 4*c* is provided in a thickness of 30 μm.

On an inner surface side of the metal layer 4*a*, in order to lower sliding friction between the inner surface of the fixing belt 4 and a temperature sensor TH1 (FIG. 4), a resin material layer (lubricating layer) 4*d* may be formed of a fluorine-containing resin material or polyimide in a thickness of 10-50 μm. In this embodiment, as this layer 4*d*, a 20 μm-thick polyimide layer is provided.

As a material for the metal layer 4*a* of the fixing belt 4, in addition to nickel, an iron alloy or the like can be appropriately selectable. Further, the metal layer 4*a* may also be constituted so that a layer of the metal or metal alloy described above is laminated on a resin material base layer. The thickness of the metal layer may be adjusted depending on a frequency of a high-frequency current caused to flow through an induction heating coil described later and depending on magnetic permeability and electrical conductivity of the metal layer and may be set in a range from 5 μm to 200 μm.

The urging member 5 is a member which is located inside the fixing belt 4 and is contactable to the inner surface of the fixing belt 4. The urging member 5 is also a member for urging (pressing) the fixing belt 4 against the pressing roller 2 as the pressing member. That is, the urging member 5 is disposed inside the fixing belt 4 by insertion and functions as a back-up member for the fixing belt 4. The urging member 5 requires rigidity for forming a fixing nip N as a press-contact portion pressurized by nipping the fixing belt 4 between the urging member 5 and the pressing roller 2. In this embodiment, as the urging member 5, an iron-made rectangular bar material (the metal member) having a rectangular cross-section is used. Further, the urging member 5 is a member slidable on the inner surface of the fixing belt 4. Therefore, the surface of the urging member 5 contactable to the fixing belt inner surface is covered with a sheet member 5*a* having a good sliding property, so that a frictional resistance with respect to the fixing belt inner surface is decreased to prevent slip of the fixing belt 4 occurring when the pressing roller 2 is rotationally driven.

Further, the urging member 5 is located close to an induction heating coil 7, described later, of the coil unit 3 particularly at both end portions, thus being liable to cause heat generation by the action of an induction (magnetic) field generated by the coil unit 3. The magnetic core 6 as the magnetic flux confining means functions as a member for causing the induction field generated by the coil unit 3 not to act on the urging member 5 in order to prevent the heat generation of the urging member 5 and is disposed on the entire upper surface of the urging member 5 with respect to the longitudinal direction of the urging member 5.

Dimensions of the urging member 5 and the magnetic core 6 with respect to the longitudinal direction (a rotational axis direction of the image heating member) are longer than a dimension of the fixing belt 4 with respect to the longitudinal direction of the fixing belt 4, so that left and right (both) end portions of each of the urging member 5 and the magnetic core 6 are outwardly projected (protruded) from those of the fixing belt 4. The left-side projected end portions of the urging member 5 and the magnetic core 6 are inserted into a supporting hole 51L provided to a left-side plate 50L of an apparatus frame 50 and is then fixed to the left-side plate 50L by an urging metal fitting 52L. Further, the right-side projected end portions of the urging member 5 and the magnetic core 6 are inserted into a supporting hole 51R provided to a right-side plate 50R of an apparatus frame 50 and is then fixed to the right-side plate 50R by an urging metal fitting 52R. As a result, the urging member 5 and the magnetic core 6 of the heating assembly 1 are horizontally fixed and disposed between the left-side plate 50L and the right-side plate 50R of the apparatus frame 50. The fixing belt 4 is loosely fitted to the above-described urging member 5 and magnetic core 6 and is rotatable around the urging member 5 and the magnetic core 6 with the urging member 5 and the magnetic core 6 as a guide portion.

b. Pressing Roller 2

The pressing roller 2 is the pressing member (a rotatable pressing member) for forming the fixing nip N which is the press-contact portion between the pressing roller 2 and the fixing belt 4. The pressing roller 2 is rotatably disposed, under the heating assembly 1, between the left-side plate 50L and the right-side plate 50R of the apparatus frame 50 through left and right bearing members 53L and 53R so that a rotational axis direction of the pressing roller 2 is substantially parallel with the longitudinal direction of the heating assembly 1.

In this embodiment, the pressing roller 2 is an elastic roller having an outer diameter of 30 mm and including an iron-made core metal 2*a* having a central portion diameter of 20 mm and both end portion diameters of 19 mm with respect to the longitudinal direction, a silicone rubber layer as an elastic layer 2*b*, and a 30 μm-thick surface parting layer 2*c* of a fluorine-containing resin material layer (e.g., PFA or PTFE). The pressing roller 2 has an ASKER-C hardness of 70 degrees at the central portion with respect to the longitudinal direction. The core metal 2*a* has a tapered shape. This is because a pressure in the nip between the fixing belt 4 and the pressing roller 2 is uniformized over the longitudinal direction even in the case where the urging member 5 is bent when the pressing roller 2 presses the fixing belt 4 against the urging member 5.

At a right-side end portion of the core metal 2*a*, a drive gear G is provided. To this drive gear G, a driving force of a driving device (motor or driving means) M is transmitted through a transmitting means (not shown), so that the pressing roller 2 is rotationally driven in a predetermined direction at a predetermined speed. By the rotation of the pressing roller 2, the fixing belt 4 is rotated. That is, the driving force for rotating the fixing belt 4 is transmitted from the pressing roller 2.

The left and right bearing members 53L and 53R are engaged in vertical guide holes 54L and 54R, respectively, provided to the left- and right-side plates 50L and 50R of the apparatus frame 50, thus being slidable vertically. That is, the pressing roller 2 is vertically slidable between the left- and right-side plates 50L and 50R. The pressing roller 2 is supported by left and right vertical shift mechanisms 55L and 55R at the left and right (both) end portions thereof. The vertical shift mechanisms 55L and 55R are, e.g., a cam mechanism, an electromagnetic solenoid mechanism, and the like, which are connected to the motor.

Figure 6:
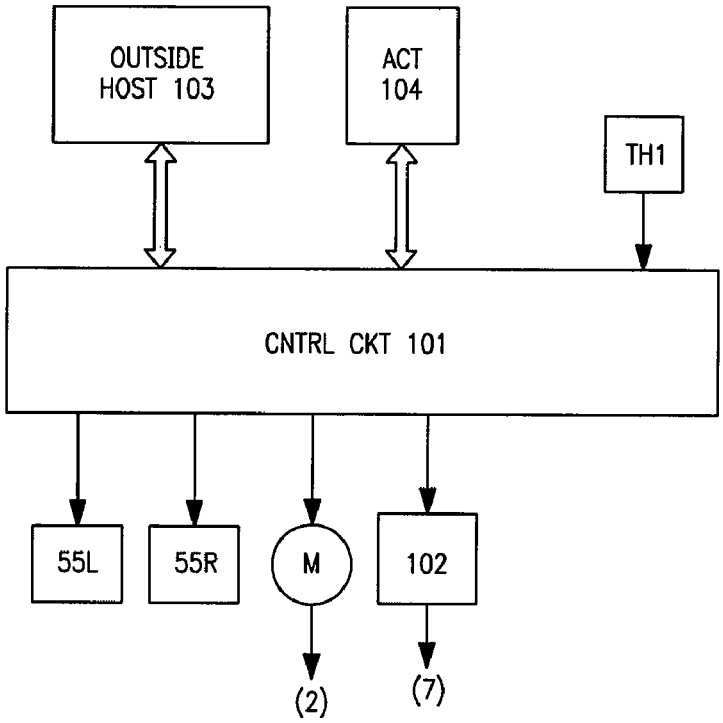
FIG. 6 is a block diagram of a control system.

The vertical shift mechanisms 55L and 55R are vertically moved by a control circuit portion 101 (FIG. 6), so that the pressing roller 2 is urged upwardly. Then, the roller upper surface portion press-contacts the fixing belt 4 toward the lower surface portion of the urging member 5 to be placed in a predetermined pressure state while resisting elasticity of the elastic layer 2*b* and thereafter the pressure state is held. In this embodiment, the pressing roller 2 is pressurized toward the lower surface of the urging member 5 through the fixing belt 4 at a total pressure of 490 N (50 kgf). By this pressurization, between the fixing belt 4 and the pressing roller 2, the fixing nip N which is the press-contact portion with a predetermined width is formed with respect to the widthwise (short-side) direction (the recording material conveyance direction). In this embodiment, the width of the fixing nip N between the fixing belt 4 and the pressing roller 2 with respect to the short-side direction is about 8 mm at the both end portions of the fixing nip N and about 7.5 mm at the central portion of the fixing nip with respect to the longitudinal direction of the fixing nip N. This has the advantage such that a conveyance speed of the recording material P at the both end portions with respect to the sheet width direction is higher than that at the central portion to less cause an occurrence of a crease of paper.

Further, the vertical shift mechanisms 55L and 55R are downwardly moved by the control circuit portion 101 to lower the pressing roller 2, so that the pressing roller 2 is held in such a state that the pressure is removed or the press-contact force is decreased.

The control circuit portion 101 controls the vertical shift mechanisms 55L and 55R to keep the pressing roller 2 in the above state in a period except for the time of performing the fixing operation. As a result, it is possible to prevent the elastic layer 2*b* of the pressing roller 2 and the fixing belt 4 from being permanently deformed.

c. Coil Unit 3

Figure 7:
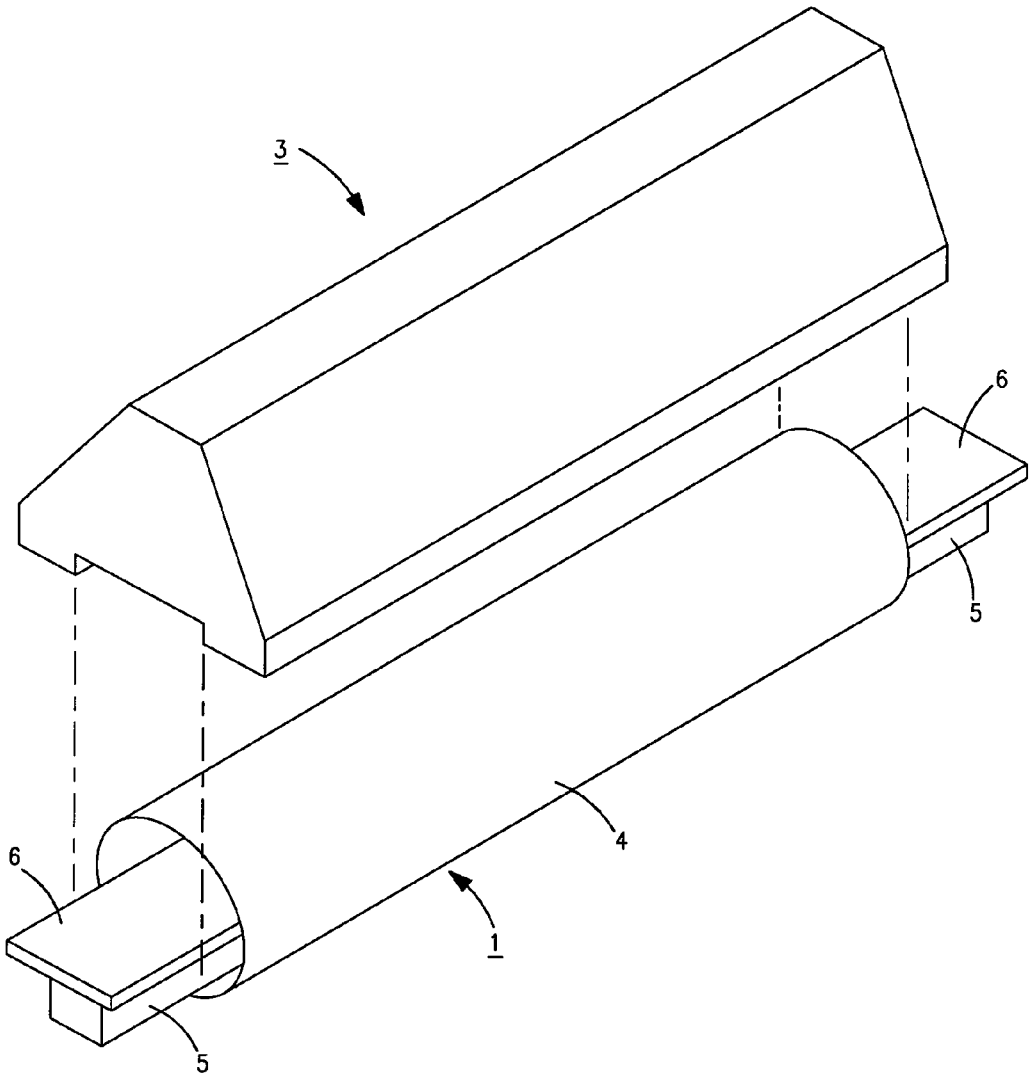
FIG. 7 is an exploded perspective view of a heating assembly and a coil unit.

The coil unit 3 is the heating source (the induction heating means) for subjecting the fixing belt 4 to induction heating. The coil unit 3 is fixedly disposed, on the upper side of the heating assembly 1, between the left- and right-side plates 50L and 50R of the apparatus frame 50 through left and right supporting metal fittings 56L and 56R so that the longitudinal direction thereof is substantially parallel to the longitudinal direction of the heating assembly 1. FIG. 7 is an exploded perspective view of the heating assembly 1 and the coil unit 3.

Figure 8:
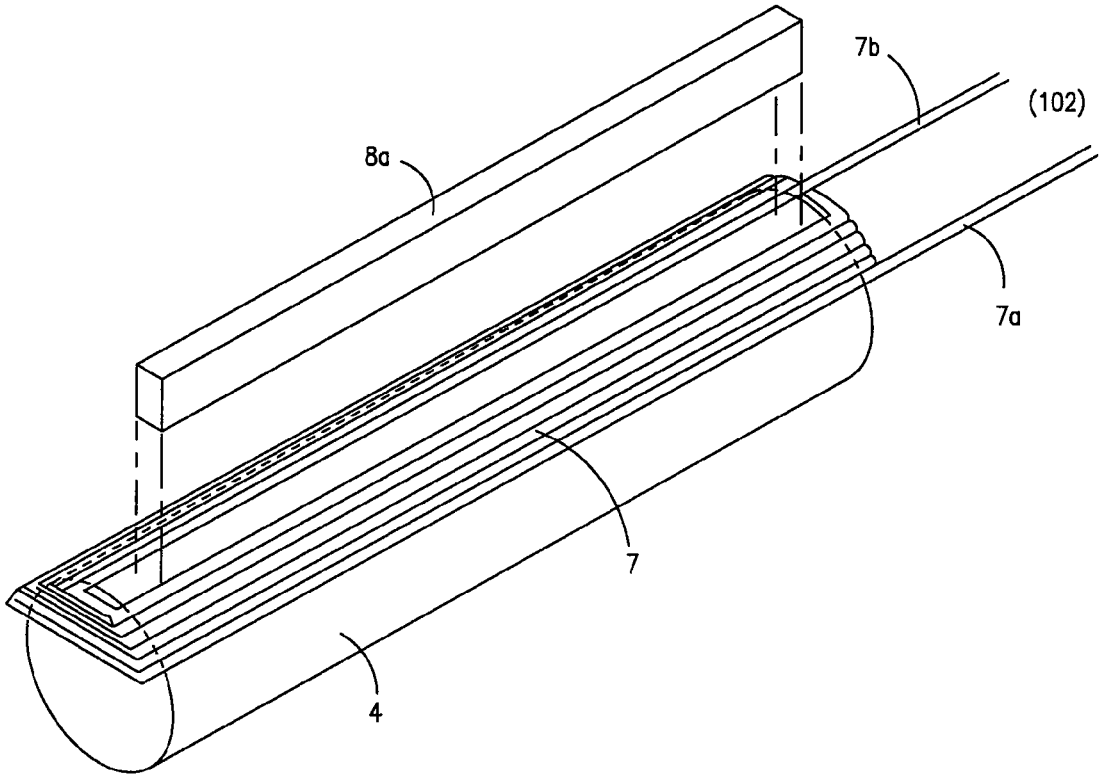
FIG. 8 is a perspective view of the fixing belt, a coil, and a magnetic core located at a central portion of the coil.

The coil unit 3 includes an induction heating coil 7, as a heating means (hereinafter simply referred to as a "coil"), which is formed with, e.g., Litz wire as an electric wire and is prepared by tightly folding and winding the wire in an elongated ship-bottom like shape as shown in FIG. 8 so that the coil unit 3 faces a part of the peripheral surface of and a part of the side surface of the fixing belt 4. Further, the coil unit 3 includes magnetic cores 8 and 8*a* which cover the coil 7 so that magnetic flux generated by the coil 7 concentrates at the metal layer 4*a* of the fixing belt 4. The coil unit 3 is such an elongated member that the coil 7 and the magnetic cores 8 and 8*a* are integrally molded by an electrically insulative resin material 9. The coil unit 3 is disposed on the upper surface side of the outer peripheral surface of the fixing belt 4 so as to face the fixing belt 4 with a predetermined gap (spacing).

The fixing belt 4 and the coil 7 are kept in an electrical insulation state by a 0.5 mm-thick mold and have a constant spacing therebetween of 1.5 mm. A distance between the mold surface and the fixing belt surface is 1.0 mm.

The coil 7 is connected to a power supply device (Induction heating paper supply portion or exciting circuit) 102, controlled by the control circuit portion 101, through lead portions 7*a* and 7*b*.

Figure 9:
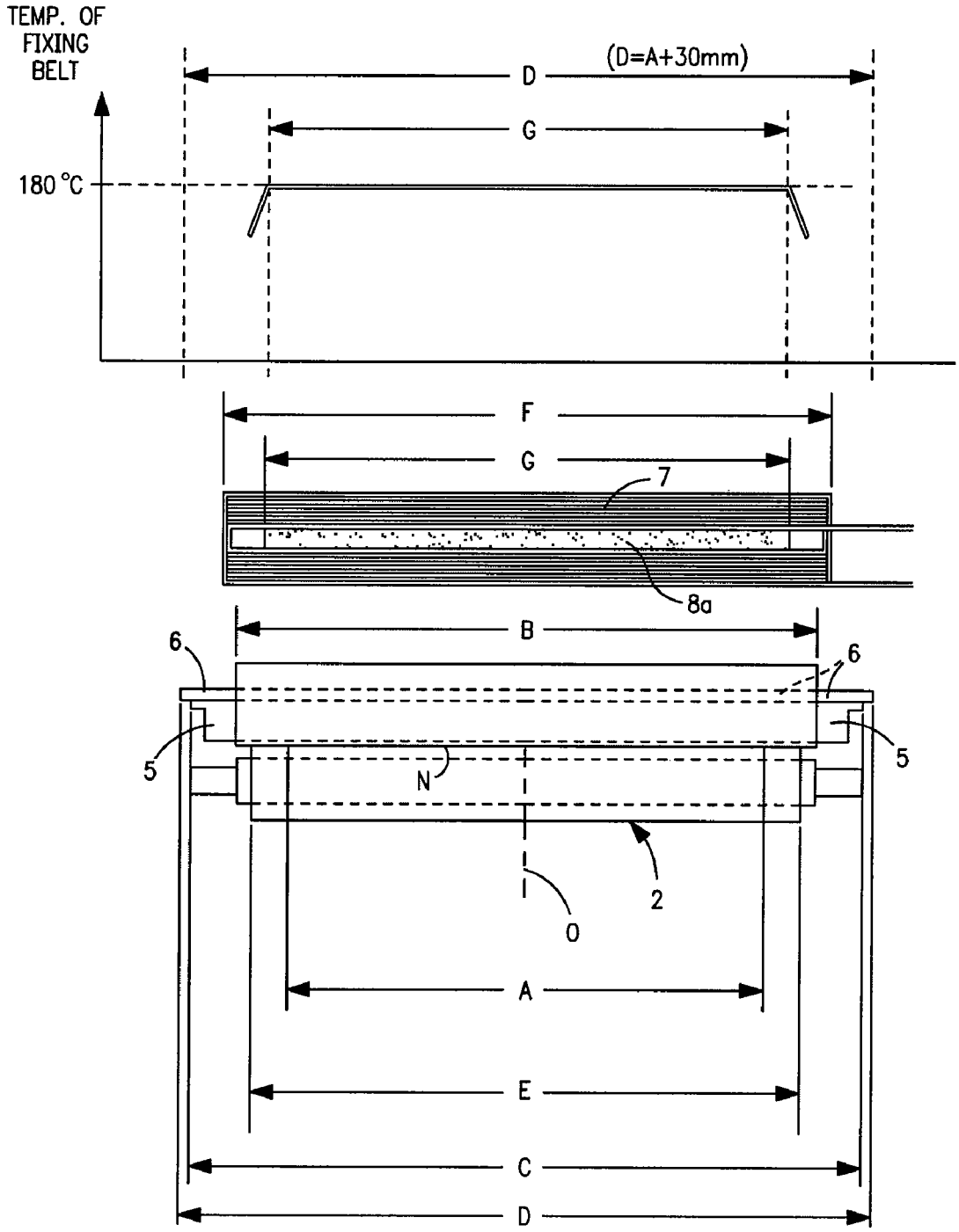
FIG. 9 includes a longitudinal arrangement view of the fixing device and a longitudinal temperature distribution of the fixing belt in Embodiment 1.

FIG. 9 is a schematic view showing a relationship among lengths of respective constituent members. In the following, the lengths of the respective constitution members are dimensions with respect to the rotational axis direction of the fixing belt 4. The sheet passing of the recording material P in the image forming apparatus in this embodiment is performed by center reference line-basis conveyance. A reference symbol O represents a center reference line (a phantom line). A reference symbol A represents a sheet passing width (a maximum sheet passing width) of the recording material P, having an available maximum sheet width, to be used by being subjected to sheet passing in the apparatus. A reference symbol B represents a length of the fixing belt 4 (with respect to a recording material sheet passing width direction). A reference symbol C represents a length of the urging member 5 and a reference symbol D represents a length of the magnetic core 6. A reference symbol E represents a length of the pressing roller 2 (a length of the elastic layer 2*b* portion of the pressing roller 2) and is also a length of the fixing nip N between the fixing belt 4 and the pressing roller 2. A reference symbol F represents a length of the coil 7 and a reference symbol G represents a length of the magnetic core 8*a* located at a central portion of the coil 7.

The length B of the fixing belt 4, the length F of the coil 7, and the length E of the pressing roller 2 are set at values larger than that of the maximum sheet passing width A. The coil 7 is formed so that its length along the recording material sheet passing width direction is longer than the maximum sheet passing width A of the recording material P, having the available maximum sheet width, to be subjected to image formation. A temperature of the fixing belt 4 is required to be uniform at a value necessary for the fixation with respect to the maximum sheet passing width A in the longitudinal direction. The magnetic core 8*a* located at the central portion of the coil 7 is particularly important with respect to the heat generation of the fixing belt 4, so that the length G of the magnetic core 8*a* is also required to be longer than the maximum sheet passing width A in order to uniformize the temperature of the fixing belt 4 over the maximum sheet passing width A. In this embodiment, the above-described lengths are constituted so as to satisfy the relationship: $A<G<E<B<F<C<D$.

d. Fixing Operation

The control circuit portion 101 (FIG. 6) sends and receives various pieces of electrical information between the control circuit portion 101 and an external host device 103 or an operating portion 104 of the image forming apparatus and controls the image forming operation of the image forming apparatus in accordance with a predetermined control program or a reference table in a centralized manner.

The fixing operation of the fixing device 100 will be described. The control circuit portion 101 changes a movement state of the vertical shift mechanisms 55L and 55R from a downward movement state to an upward movement state, at least during execution of the image formation, on the basis of an image formation start signal. As a result, the pressing roller 2 is placed in a predetermined pressure state such that the pressing roller 2 press-contacts the fixing belt 4 toward the lower surface portion of the urging member 5 of the heating assembly 1 while resisting elasticity of the elastic layer 2*b*, thus being placed in a state in which a predetermined fixing nip N is formed.

Further, the control circuit portion 101 turns a driving device M on and turns the power supply device 102 on. By the turning-on of the driving device M, the pressing roller 2 is rotationally driven at a predetermined speed in a counter-clockwise direction indicated by an arrow in FIG. 4. By the rotation of the pressing roller 2, a rotational force acts on the fixing belt 4 on the basis of a frictional force between the surface of the pressing roller 2 and the surface of the fixing belt 4 at the fixing nip N. The fixing belt 4 is rotated, around the urging member 5 and the magnetic core 6, by the pressing roller 2 at a speed substantially equal to the rotational speed of the pressing roller 2 in a clockwise direction indicated by an arrow while an inner surface of the fixing belt 4 intimately contacts and slides on the lower surface of the urging member 5. The urging member 5 and the magnetic core 6 also function as a guide member for the rotating fixing belt 4. The rotating fixing belt 4 includes the base layer 4*a* formed of metal, so that it is sufficient to provide a flange member for simply stopping the end portion of the fixing belt 4 as a means for regulating lateral movement of the fixing belt 4 with respect to a length direction even when the fixing belt 4 is placed in a rotation state. In this embodiment, an inside surface 3L (FIG. 3) located at the left-side end portion of the coil unit 3 is used as the flange member for regulating leftward lateral movement of the fixing belt 4 by stopping the left-side end portion of the fixing belt 4. Further, an inside surface 3R (FIG. 3) located at the right-side end portion of the coil unit 3 is used as the flange member for regulating rightward lateral movement of the fixing belt 4 by stopping the right-side end portion of the fixing belt 4. As a result, there is an advantage such that the constitution of the fixing device 100 can be simplified.

Further, by the turning-on of the power supply device 102, a high-frequency current of 20-50 kHz is applied to the coil 7 of the coil unit 3, so that the metal layer 4*a* of the fixing belt 4 is subjected to induction heating by the magnetic field generated by the coil 7. By the heat generation of this metal layer 4*a*, the rotating fixing belt 4 increases in temperature. The control circuit portion 101 performs temperature control by changing a frequency of the high-frequency current on the basis of a detected value of the temperature sensor TH1 for detecting the temperature of the fixing belt 4 to control electric power inputted into the coil 7 so that the temperature of the fixing belt 4 is substantially constant at a predetermined target temperature value (a fixing temperature value). In this embodiment, the temperature control is performed so that the temperature of the fixing belt 4 is substantially constant at 180° C. The temperature sensor TH1 detects the temperature of the fixing belt portion corresponding to a sheet passing portion (area), so that information of the detected temperature is fed back to the control circuit portion 101. The control circuit portion 101 controls the electric power to be inputted from the power supply device 102 to the coil 7 so that the detected temperature to be inputted from the temperature sensor TH1 is kept at the predetermined target temperature value. That is, in the case where the detected temperature of the fixing belt 4 reaches the predetermined temperature, energization to the coil 7 is interrupted.

With respect to the warming-up time of the fixing device 100, e.g., when electric power of 1200 W is inputted into the coil 7, the fixing belt temperature can reach 180° C. as the target temperature in about 15 seconds.

The temperature sensor TH1 is, e.g., a temperature detecting element such as a thermistor and is supported by being attached to an end of an elastic supporting member 10 fixed at a base portion to the urging member 5 or the magnetic core 6. The temperature sensor TH1 is disposed, substantially at the central portion of the fixing belt 4 with respect to the longitudinal direction, elastically in contact with the inside of the fixing belt 4 by elasticity of the elastic supporting member 10. Further, the temperature sensor TH1 is disposed in contact with the inner surface of the fixing belt 4 in an area in which an amount of heating generation by the coil 7 is largest, thus detecting the temperature at the portion. The temperature sensor TH1 is constituted so as to keep a good contact state by following positional variation such that the contact surface of the fixing belt 4 is waved by the elastic supporting member 100 even when the position variation occurs.

Figure 10:
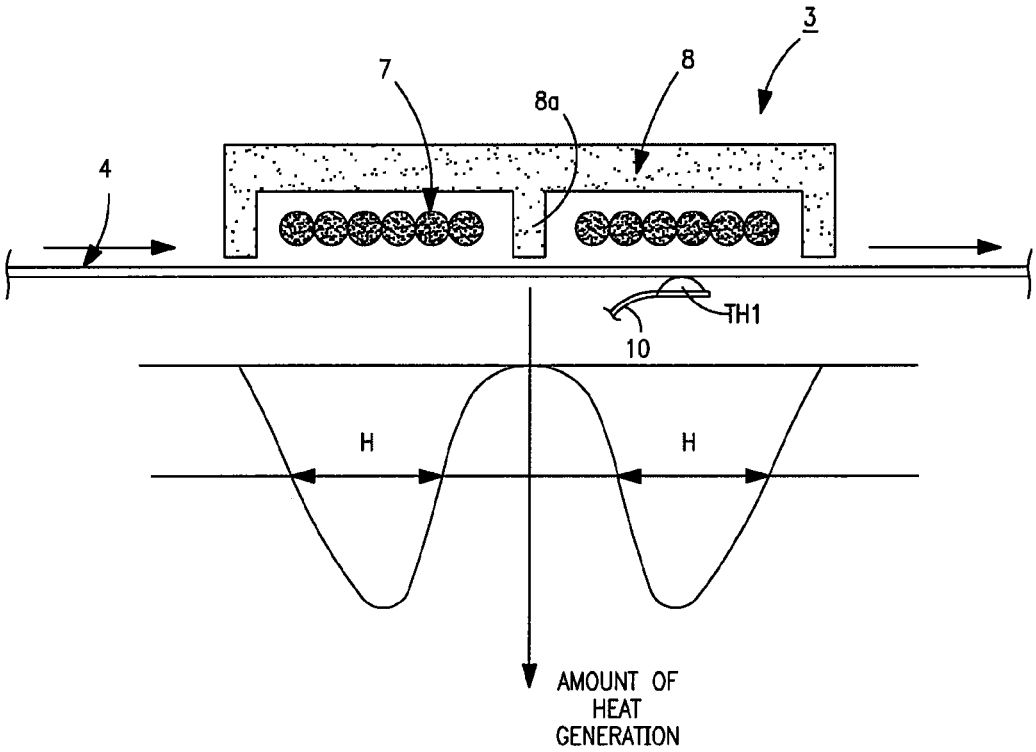
FIG. 10 is a distribution diagram of an amount of heat generation of the fixing belt at an opposing portion (development view) between the fixing belt and a coil unit (an induction heating coil).

FIG. 10 shows a distribution diagram of the amount of heat generation of the fixing belt 4 at an opposing portion (development view) between the fixing belt 4 and the coil unit 3 (the coil 7). There are two portions H and H at which the amount of heat generation is large. That is, a position in which the amount of heat generation of the fixing belt 4 is largest is located at a central portion of each of separated two regions, shown in FIGS. 4 and 10 with respect to the fixing belt rotational direction, facing two coil portions separated by the magnetic core 8*a*. In one of the separated two regions, the temperature sensor TH1 is shown. The temperature sensor TH1 is disposed in contact with the inner surface of the fixing belt 4 at a position in which the amount of heat generation by the coil 7 is largest. When the temperature sensor TH1 is disposed as in this embodiment, it is possible to detect the temperature in the area (region) in which the fixing belt 4 causes the heat generation most, so that temperature rise of the fixing belt 4 to an abnormal temperature for some reason is detectable with high accuracy and a high response speed. Therefore, at the control circuit portion 101, it is possible to judge that the fixing belt 4 causes the abnormal temperature rise as quickly as possible on the basis of information of the detected temperature from the temperature sensor TH1, so that the electric power supply to the coil 7 can be quickly interrupted. When the abnormal temperature rise occurs during execution of an image forming job, interruption of the job is also performed in interrelation with the interruption of the electric power supply. As a result, it is possible to prevent the fixing device (the fixing belt) to break. In that case, the control circuit portion 101 outputs a signal in order to urge an operator to carry out repair by displaying a message to the effect that the image forming apparatus, particularly the fixing device, is placed in an abnormal state at the operating portion 104 consisting of a liquid crystal display portion provided to the image forming apparatus.

Incidentally, in the case where the image forming apparatus functions as a printer by being connected through a communication cable to a host computer such as a personal computer on a LAN (local-area network), the message to the effect that the image forming apparatus (the fixing device) is placed in the abnormal state is provided to the personal computer. That is, the control circuit portion 101 outputs a signal, for indicating the message to the effect that the image forming apparatus (the fixing device) is placed in the abnormal state, toward the personal computer.

In the above-described manner, the pressing roller 2 is driven and the fixing belt 4 is increased in temperature to the predetermined fixing temperature to be temperature-controlled. Then, in this state, the recording material P having an unfixed toner image T is guided by the guide member 11 and is introduced into the fixing belt 4 with its toner image carrying surface toward the fixing belt 4 side. The recording material P intimately contacts the outer peripheral surface of the fixing belt 4 in the fixing nip N and is nipped and conveyed in the fixing nip N together with the fixing belt 4. As a result, heat of the fixing belt 4 is imparted to the recording material P and a pressing force in the fixing nip N is applied to the unfixed toner image T, so that the unfixed toner image T is fixed on the surface of the recording material P by heating under pressure. The recording material P passed through the fixing nip N is subjected to self-separation from the outer peripheral surface by deformation of the surface of the fixing belt at an exit portion of the fixing nip N.

The fixing belt 4 is rotated by the pressing roller 2 rotationally driven by the driving device M with no crease at a peripheral speed substantially equal to the conveyance speed of the recording material P, carrying thereon the unfixed toner image T<which is conveyed from the image transfer portion side. In this embodiment, the fixing belt 4 is rotated at a surface rotational speed of the fixing belt 4 of 210 mm/sec., so that it is possible to fix a full-color image on an A4-sized recording material P at a rate of 50 sheets/min.

In this embodiment, the coil unit 3 including the coil 7 is disposed outside, not inside the fixing belt 4 in which the temperature of the fixing belt 4 is high, so that the temperature of the coil 7 is less liable to reach a high temperature. Therefore, there is an advantage such that an inexpensive heat resistant-grade coil material can be used. Further, the temperature of the coil 7 does not reach the high temperature, so that there is also an advantage such that an electric resistance is not increased to alleviate loss due to Joule heat even by passage of the high-frequency current. The disposition of the coil 7 on the outside of the fixing belt 4 also contributes to a reduction in diameter (a reduction in thermal capacity) of the fixing belt 4.

e. Downsizing of fixing device and improvement in heat generating efficiency

A constitution for downsizing of the fixing device 100 and heat generating efficiency improvement will be described with reference to FIG. 9.

The temperature of the fixing belt 4 is required to be uniform at a value necessary for the fixation with respect to the maximum sheet passing width A in the longitudinal direction. The magnetic core 8*a* located at the central portion of the coil 7 is particularly important with respect to the heat generation of the fixing belt 4, so that the length G of the magnetic core 8*a* is also required to be longer than the maximum sheet passing width A in order to uniformize the temperature of the fixing belt 4 over the maximum sheet passing width A. In this embodiment, the coil 7 winded and folded in the ship bottom-like shape is used, so that the length F of the coil 7 is only required to be slightly longer than the length of the magnetic core 8*a* equal to the maximum sheet passing width A even when the magnetic core 8*a* having the length equal to the maximum sheet passing width A is disposed at the central portion of the coil 7. However, at the both end portions of the ship bottom-like shaped coil 7, due to the coil shape, a distance between the coil 7 and the iron-made urging member 5 is decreased.

Therefore, in order that the iron-made urging member 5 does not generate heat by the coil 7, in this embodiment, the magnetic core 6 having the length D which is longer than the length F of the coil 7 by 10 mm (5 mm for each end portion) is disposed on the upper surface of the urging member 5. In the case of this embodiment, the fixing belt temperature in the area corresponding to the maximum sheet passing width A can be made substantially constant at 180° C. as the target temperature. Further, the length G of the magnetic core 8*a* is set so as to be longer than the maximum sheet passing width A by 10 mm (5 mm for each end portion) and the length F of the coil 7 is set so as to be longer than the length G of the magnetic core 8*a* by 10 mm (5 mm for each end portion). The length D of the magnetic core 6 required to be longest among those of the respective members needs to be longer than the length F of the coil by 10 mm (5 mm for each end portion) in order to ensure magnetic shielding, so that the length D satisfies D=A+30 mm.

In the foregoing embodiment, the coil in the coil unit is compressed at the opposite end portions in the longitudinal direction. However, the present invention is not limited to such a compressed structure, although the compressed structure is preferable since then the length of the image heating apparatus is reduced.

The efficiency of the power supply device 102 in this embodiment is 93% but that in the case of using the coil 7 (for comparison) is lowered to 90%. Herein, the efficiency of the power supply device 102 refers to a ratio (%) of electric power inputted into the coil 7 to electric power inputted into the power supply device 102.

As shown in FIG. 9, in this embodiment, the coil 7 is wound around the upper surface and both (upper) end side surfaces of the fixing belt 4 so that the length D of the magnetic core 6 is longer than the length F of the coil 7, that the length F of the coil 7 is longer than the length B of the fixing belt 4, and that the length D of the magnetic core 6 is longer than the length C of the urging member 5. By this constitution, it was also possible to provide a fixing device (an image heating apparatus) which had a short longitudinal direction length and a small size and suppressed heat generation to realize a high heat generating efficiency.

[Embodiment 2]

Figure 11:
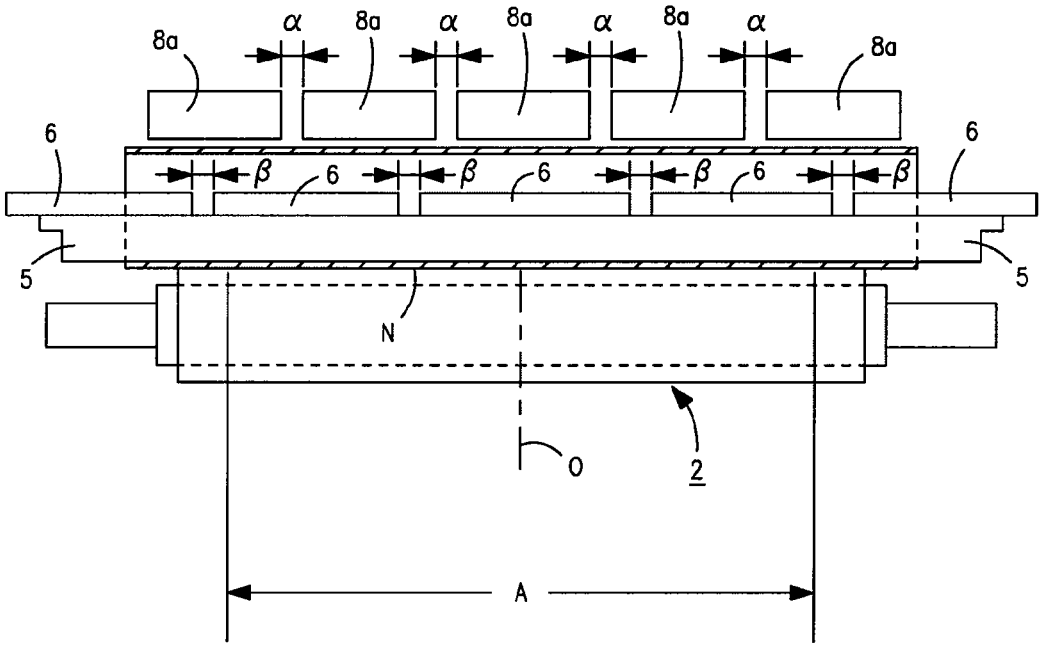
FIG. 11 is an arrangement view of a core member of a fixing device in Embodiment 2.

In this embodiment, as shown in FIG. 11, the fixing device 100 in the above-described embodiment 1 is changed so that each of the magnetic core 6 and the magnetic core 8*a* which is disposed at the central portion of the coil 7 is divided into a plurality of magnetic core portions. Other device constitutes in this embodiment are identical to those in Embodiment 1.

The magnetic cores are generally manufactured by baking a powdery material, so that a resultant product is liable to cause warpage or the like, thus being poor in dimensional accuracy. For this reason, when the core member is not disposed as a single part with respect to the longitudinal direction but is disposed in a division manner, it is possible to employ an inexpensive magnetic core capable of alleviating part accuracy such as the warpage or the like. However, it is not preferable that the lowering in efficiency of the power supply device 102 and the heat generation of the urging member 5 are caused to occur when the core member is divided.

In order to prevent the lowering in efficiency and the heat generation, in this embodiment, spacings $\alpha$ of the divided magnetic core portions 8*a* and spacings $\beta$ of the divided magnetic core portions 6 are disposed so as not to coincide with each other at positions with respect to the longitudinal direction.

Further, each spacing between adjacent magnetic core portions may preferably be equal to or less than the thickness of associated magnetic core portions. In this embodiment, each magnetic core portion has the thickness of o3 mm, so that each spacing is set at 2.5 mm.

When the respective magnetic core portions are disposed in the above-descried manner, the efficiency of the power supply device 102 can achieve 92% which is substantially equal to 93% in Embodiment 1 in which the core member is not divided, so that an inexpensive core member can be employed.

The image heating apparatus of the present invention can be used as not only the image heating fixing device in the above-described embodiments but also other image heating apparatuses including, e.g., an image heating apparatus for modifying a surface property such as gloss by heating a recording material which carries an image, an image heating apparatus for temporary fixation, and the like. Further, in an image forming apparatus of an ink jet type, the image heating apparatus described above can also be used as an image heating apparatus for drying the recording material on which the image is formed by the ink jet method.

According to the present invention, it is possible to provide an image heating apparatus of electromagnetic induction heating type having a longitudinal direction length and capable of downsizing. Further, it is also possible to provide an image heating apparatus of the electromagnetic induction heating type capable of suppressing heat generation of the urging member to realize a high heat generating efficiency.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 125486/2008 filed May 13, 2008, which is hereby incorporated by reference.

What is claimed is:

1. An image heating apparatus comprising:

a rotatable image heating member, including an electroconductive layer, for heating a recording material by heat;

a coil, disposed outside said image heating member, configured to generate magnetic flux for generating heat in the electroconductive layer, said coil having an end, with respect to a rotational axis direction of said image heating member, located outside an end of said image heating member with respect to the rotational axis direction;

a pressing member, contacting an outer surface of said image heating member, configured to form a nip in which the recording material is to be nipped and conveyed;

a metal member configured to press said pressing member through said image heating member, said metal member having an end which is located outside the end of said image heating member and is located outside an end of said coil with respect to the rotational axis direction; and magnetic flux confining means, disposed inside said image heating member and between said coil and said metal member, for confining the magnetic flux from said coil so as not to extend toward said metal member, said magnetic flux confining means having an end located outside the end of said image heating member with respect to the rotational axis direction.

2. An apparatus according to claim 1, wherein the end of said magnetic flux confining means is located outside the end of said metal member with respect to the rotational axis direction.

3. An apparatus according to claim 1, wherein said image heating member is a belt member.

4. An apparatus according to claim 1, wherein said image heating member is a belt member to which a driving force for rotating the belt member is to be transmitted from said pressing member.

5. An apparatus according to claim 1, wherein said magnetic flux confining means is a magnetic core.

6. An apparatus according to claim 1, wherein said magnetic flux confining means has a width larger than that of said metal member with respect to a conveyance direction of the recording material.

7. An apparatus according to claim 1, wherein said magnetic flux confining means is a plurality of magnetic cores which are disposed in an area inside said image heating member at predetermined intervals.

8. An apparatus according to claim 1, further comprising a flange member, provided at each of end portions of said image heating member, configured to prevent movement of said image heating member in the rotational axis direction.

9. An apparatus according to claim 1, further comprising driving means for driving said pressing member, wherein to said image heating member, a driving force is transmitted from said pressing member.

10. An image heating apparatus comprising:

a rotatable image heating member, including an electroconductive layer, configured to heat a recording material by heat;

a coil, disposed outside said image heating member, configured to generate magnetic flux for generating heat in the electroconductive layer, said coil having an end, with respect to a rotational axis direction of said image heating member, located outside an end of said image heating member with respect to the rotational axis direction;

a pressing member, contacting an outer surface of said image heating member, configured to form a nip in which the recording material is to be nipped and conveyed;

a metal member configured to press said pressing member through said image heating member, said metal member having an end which is located outside the end of said image heating member and is located outside an end of said coil with respect to the rotational axis direction; and magnetic flux confining means, disposed inside said image heating member and between said coil and said metal member, for confining the magnetic flux from said coil so as not to extend toward said metal member, said magnetic flux confining means having an end which is located outside the end of said image heating member and is located outside the end of said metal member with respect to the rotational axis direction.

11. An apparatus according to claim 10, wherein said image heating member is a belt member.

12. An apparatus according to claim 10, wherein said image heating member is a belt member to which a driving force for rotating the belt member is to be transmitted from said pressing member.

13. An apparatus according to claim 10, wherein said magnetic flux confining means is a magnetic core.

14. An apparatus according to claim 10, wherein said magnetic flux confining means has a width larger than that of said metal member with respect to a conveyance direction of the recording material.

15. An apparatus according to claim 10, wherein said magnetic flux confining means is a plurality of magnetic cores which are disposed in an area inside said image heating member at predetermined intervals.

16. An apparatus according to claim 10, further comprising a flange member, provided at each of end portions of said image heating member, configured to prevent movement of said image heating member in the rotational axis direction.

17. An apparatus according to claim 10, further comprising driving means for driving said pressing member, wherein to said image heating member, a driving force is transmitted from said pressing member.

* * * * *